US009687047B1

(12) United States Patent
Talley

(10) Patent No.: US 9,687,047 B1
(45) Date of Patent: Jun. 27, 2017

(54) SUICIDE PREVENTION LACES

(71) Applicant: U-Lace, LLC, Rochester, NY (US)

(72) Inventor: Timothy J. Talley, Rochester, NY (US)

(73) Assignee: U-LACE, LLC, Rochester, NY (US)

( * ) Notice: Subject to any disclaimer, the term of this patent is extended or adjusted under 35 U.S.C. 154(b) by 0 days.

(21) Appl. No.: 15/343,265

(22) Filed: Nov. 4, 2016

(51) Int. Cl.

| | |
|---|---|
| ***A43C 11/22*** | (2006.01) |
| ***A43C 9/00*** | (2006.01) |
| ***A41F 1/00*** | (2006.01) |
| ***A43C 1/00*** | (2006.01) |
| ***A43C 5/00*** | (2006.01) |

(52) U.S. Cl.
CPC ..... *A43C 11/22* (2013.01); *A41F 1/00* (2013.01); *A43C 1/00* (2013.01); *A43C 5/00* (2013.01); *A43C 9/00* (2013.01)

(58) Field of Classification Search
CPC .. A43C 9/00; A43C 9/02; A43C 11/22; Y10T 24/3726; Y10T 24/3729
See application file for complete search history.

(56) References Cited

U.S. PATENT DOCUMENTS 1,353,614 A * 9/1920 Ross ..... A43C 11/22 36/50.1
2,266,083 A * 12/1941 Rzepa ..... A43C 11/22 24/267

* cited by examiner

*Primary Examiner* — Abigail Troy
(74) *Attorney, Agent, or Firm* — Ladas & Parry LLP

(57) ABSTRACT

A lace product for threading into a shoe or garment including: a plurality of single eyelet laces, a spine, stitching securing each of the plurality of single eyelet laces to the spine such that the single eyelet laces cannot be separated from the spine with a force of less than 400 lbs.

13 Claims, 4 Drawing Sheets

SUICIDE PREVENTION LACES

FIELD OF INVENTION

The invention relates to an improvement in single eyelet laces that prevents the use of such laces to harm oneself or others.

BACKGROUND OF INVENTION

Single eyelet laces are known wherein a single lace extends between a single pair of eyelets on opposite sides of a shoe or garment. For example, single eyelet laces are described in the inventor's own U.S. Pat. Nos. 8,448,354 and 8,677,579. Single eyelet laces are also described, for example, in Tricker U.S. Pat. No. 7,036,194 of May 2, 2006, Head GB Patent 657,958 of Oct. 3, 1951, and Gentry U.S. Pat. No. 4,733,439 of Mar. 29, 1988. In these patents, the contents of which are incorporated herein by reference in their entireties, a different lace can be disposed to extend between each pair of opposing eyelets in the shoe or garment, and the shoe or garment may be provided with a plurality of pairs of eyelets with each of the respective laces in the shoe or garment extending between a different pair of eyelets. The laces in this arrangement do not necessarily crisscross as in a conventional tying arrangement with "regular" laces, although they may be arranged in a criss-cross pattern if desired, as users can choose to pass the laces through any two (2) eyelets they wish.

The inventor has become aware that, as is the case with regular laces, it is possible to string a number of single eyelet laces together to form an elongate strand of lace material that can be used to strangulate oneself or another. This is a problem, in particular, in jails, mental hospitals or other institutional settings where residents may be prone to violence or self harm. What is needed is a lace product that allows the residents to enjoy the benefits of a shoelace without the risk engendered by providing them with either regular or single eyelet laces that may be strung together and used in an inappropriate manner.

In accordance with the invention, there is provided a lace product for threading into a shoe or garment comprising:

(a) a plurality of single eyelet laces, each of the single eyelet laces comprising first and second end portions and a central portion, each of the first and second end portions of the single eyelet laces comprising an aglet affixed thereto;

(b) a spine;

(c) means for securing each of the plurality of single eyelet laces to the spine such that the single eyelet laces cannot be separated from the spine with a force of less than 400 lbs and preferably cannot be separated from the spine with a force of less than 600 lbs;

wherein the means secures the central portion of each of the respective plurality of single eyelet laces to the spine with the first and second end portions of each of the respective single eyelet laces projecting on opposite sides of the spine and with the respective central portions of the single eyelet laces being spaced from one another a distance sufficient to permit the aglets of respective single eyelet laces to be threaded into respective eyelets of the shoe or garment.

In a preferred embodiment of the invention, the spine is made of a fabric that is not tearable. In another preferred embodiment, the spine is made of ballistic nylon. Preferably, the spine is flat.

In yet another preferred embodiment, the means for securing comprises an aramid thread of high tensile strength, preferably KEVLAR® thread. Preferably, the tensile strength of the aramid thread is at least 50 lbs and preferably at least 60 lbs. In still a further embodiment of the invention, the aramid thread is the same color as the ballistic nylon.

In a still further embodiment, no fewer than four (4) rows of concealed stitching are utilized to secure and seal the laces within the spine. The plurality of stitches—each of which doubles the strength of the thread—combine also to multiply the strength of the overall unit to between 8 and 12 times the strength of the 50 lb rated thread.

In still a further embodiment of the invention, each of the plurality of single eyelet laces is disposed transverse to the spine.

In yet another embodiment of the invention, there is provided a kit comprising any one of the lace products described herein and a shoe comprising a plurality of pairs of eyelets, wherein the respective single eyelet laces of the lace product are secured to the in a spacing that permits the aglets of the respective single eyelet laces to be threaded into respective of the plurality of pairs of eyelets of the shoe.

BRIEF DESCRIPTION OF THE DRAWING

These embodiments and the method of their use will be better understood from consideration of the accompanying drawing figures that illustrate but do not limit the invention in which.

DETAILED DESCRIPTION

As used herein, "single eyelet laces" comprehends any elongate flexible members that can extend between a single pair of eyelets of a shoe or garment, regardless of flat, round, or other cross section.

Figure 2:
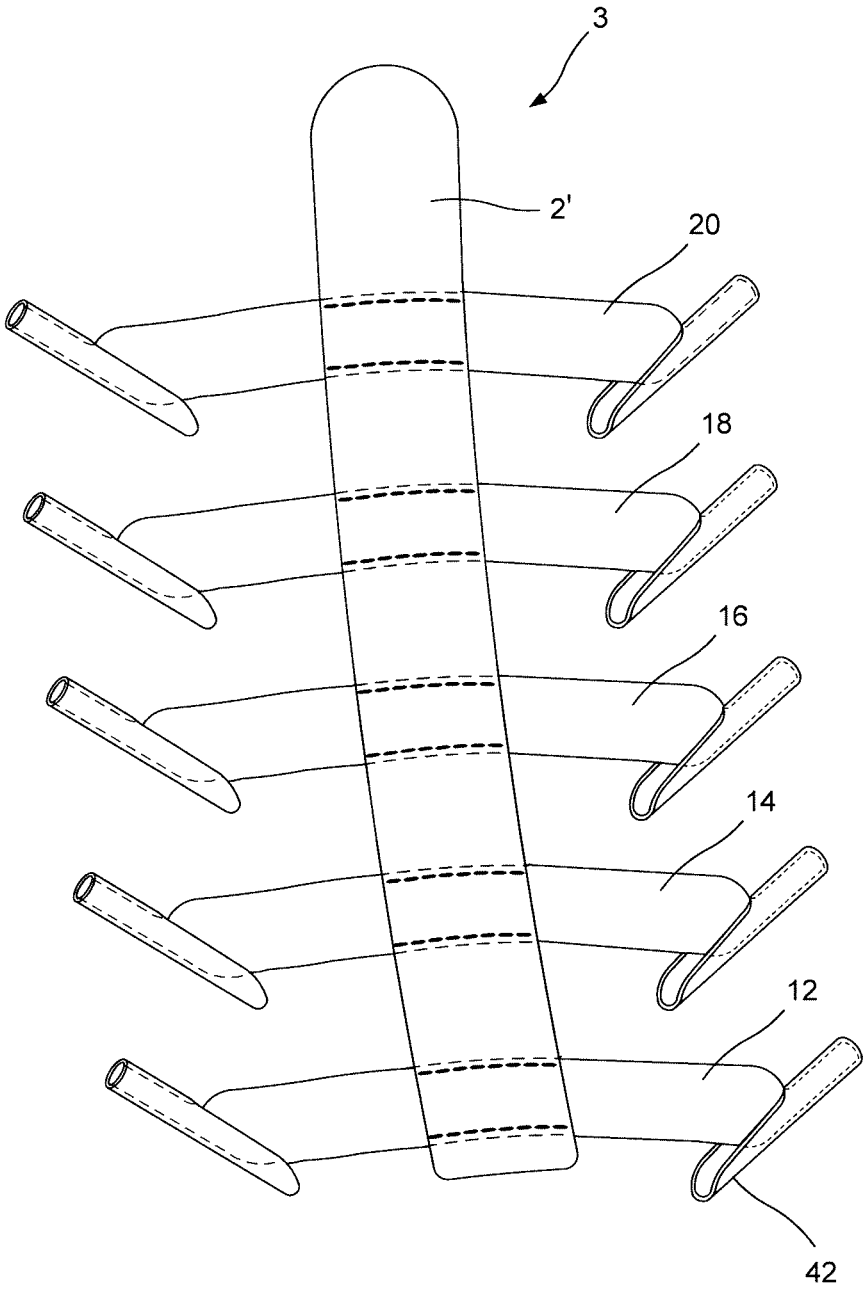
FIG. 2 shows a lace product of the invention in a first embodiment with five single eyelet laces secured to the spine.
Figure 3:
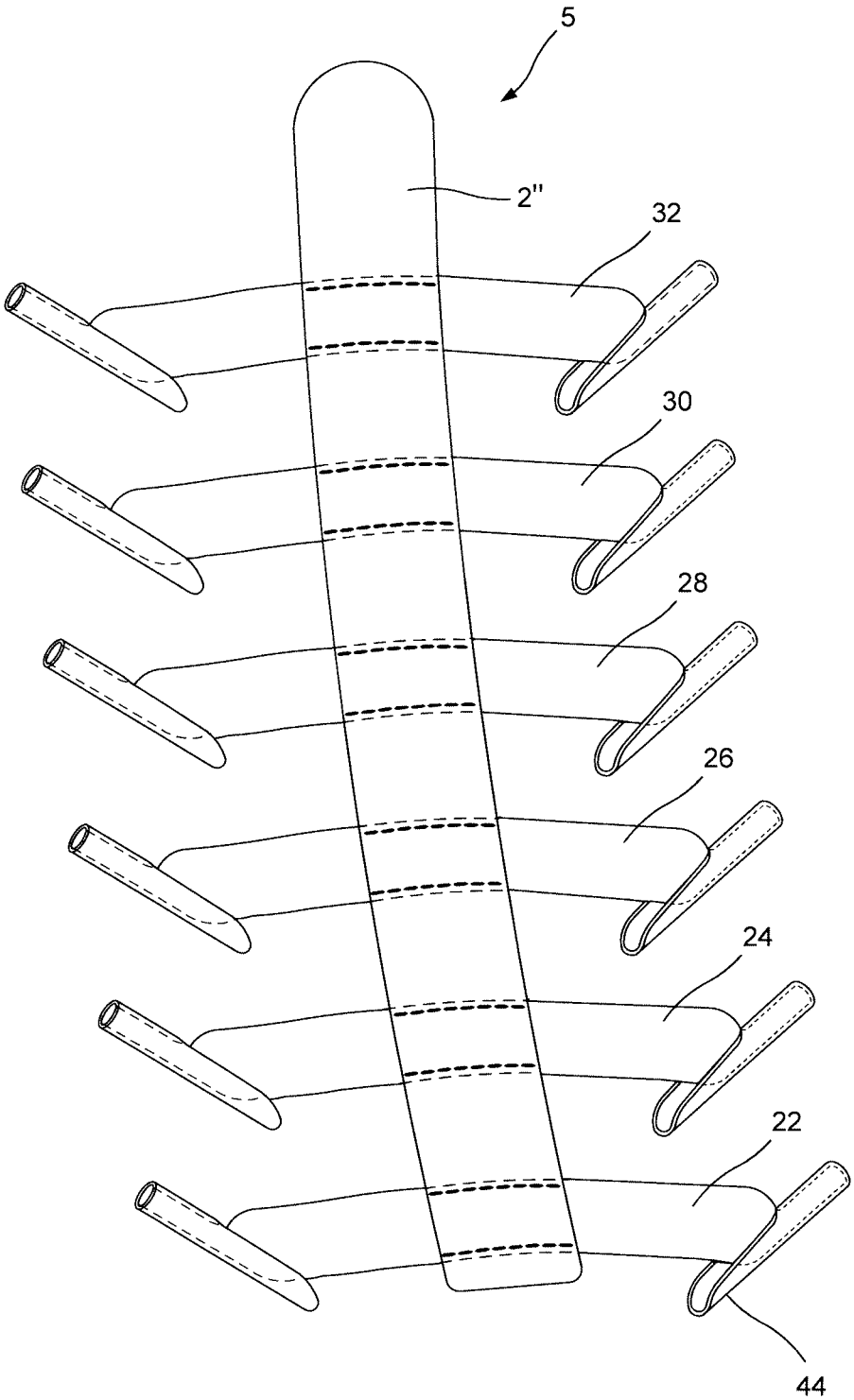
FIG. 3 shows a lace product of the invention in a first embodiment with six single eyelet laces secured to the spine.
Figure 4:
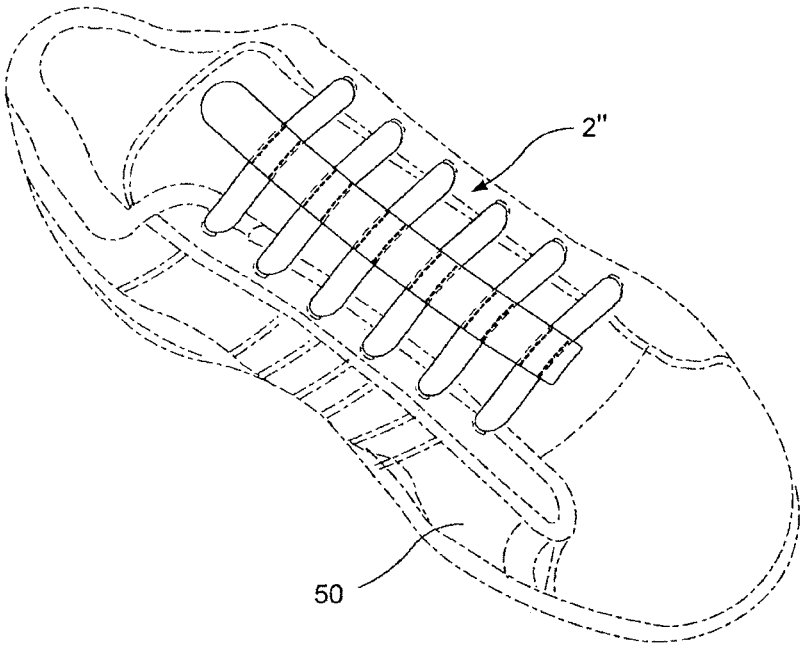
FIG. 4 shows the lace product of FIG. 3 threaded in a shoe.

As shown in the drawings, each of the lace products 1 (FIG. 1), 3 (FIG. 2) and 5 (FIG. 3) comprises a respective spine 2, 2' or 2" to which is affixed a plurality of single eyelet laces 4, 6, 8, and 10 (FIG. 1), 12, 14, 16, 18 and 20 (FIG. 2) or 22, 24, 26, 28, 30 and 32 (FIG. 3). Each of the single eyelet laces has a first end and a second end to which is affixed an aglet 40 (FIG. 1), 42 (FIG. 2) or 44 (FIG. 3). Each of the aglets is disposable in a plurality of positions with respect to the single eyelet lace to which it is attached so that each aglet can be moved from a first position wherein the body of the aglet is disposed parallel to a longitudinal axis of the single eyelet lace to a second position wherein the aglet is disposed transverse to the longitudinal axis.

Figure 1:
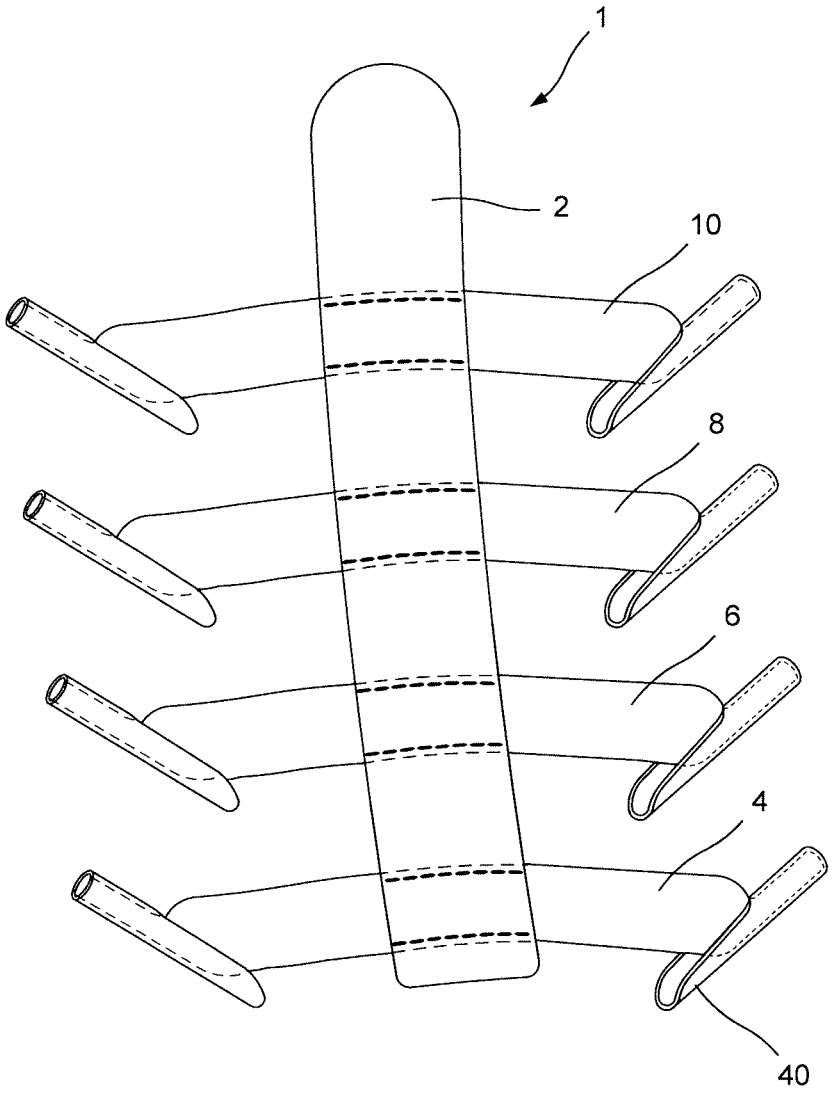
FIG. 1 shows a lace product of the invention in a first embodiment with four single eyelet laces secured to the spine.
Figure 5:
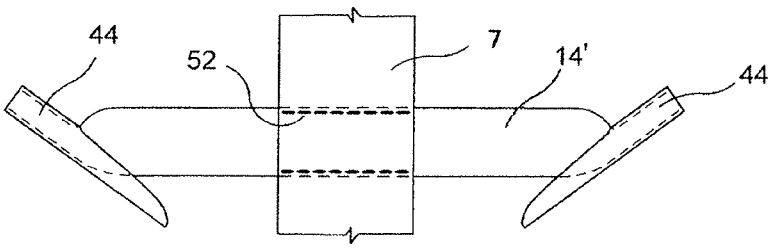
FIG. 5 shows a lace of the invention with an elongate flexible member secured to the spine with stitching.

The respective single eyelet laces of the respective lace products 1, 3 and 5 are secured to the respective spines 2, 2' and 2" in the disposition shown in FIGS. 1-3, i.e., with the single eyelet laces crossing the spines and, preferably, substantially transverse to the spines. The respective spines are made of non-tearable material such that the spines cannot be torn. As shown in FIG. 5, a single eyelet lace 14' can be secured to the respective spine 7 with stitching 52 comprising, for example, high tensile thread, which is preferably of the same color as the color of the spine. In this way, once the thread is sewn into the ballistic nylon webbing, it basically becomes camouflaged and "disappears" making it nearly impossible for the threads to be found and tampered with. Moreover, the preferred threads, e.g., KEVLAR® thread, are basically only susceptible to a blade and cannot be otherwise torn. One of skill in the art would thus appreciate that, with the lace product so formed, the single eyelet laces are basically permanently joined to the spine. Without a blade or similar tool, there would be no way for a person to string them together to make a lace long enough to strangulate himself or another.

A method of using the lace product comprises (a) passing a first aglet of a single eyelet lace through one eyelet of a shoe or garment inside to outside while the aglet is in the body-parallel position and then changing the disposition of the aglet to the transverse position to secure the aglet in the eyelet; and (b) passing a second aglet of the single eyelet lace through an opposing eyelet of the shoe in a similar fashion to secure the second aglet in the opposing eyelet. The single eyelet lace is preferably elastic so that it can pull the eyelets together when the eyelets are on opposite sides of a portion of the shoe or garment. Each of the respective single eyelet laces of the lace product can be threaded through the respective eyelets of a shoe in similar fashion to enable a person to lace a shoe onto his or her foot in a secure manner. Thus, a person with suicidal or homicidal tendencies can be provided with laces that enable him or her to use them in the intended manner without fear that they may be used inappropriately.

What is claimed is:

1. A lace product for threading into a shoe or garment comprising:

(a) a plurality of single eyelet laces, each of the single eyelet laces comprising first and second end portions and a central portion, each of the first and second end portions of the single eyelet laces comprising an aglet affixed thereto;

(b) a spine;

(c) means for securing each of the plurality of single eyelet laces to the spine such that the single eyelet laces cannot be manually separated from the spine by application of a tensile force of less than 400 lbs;

wherein the means secures the central portion of each of the respective plurality of single eyelet laces to the spine with the first and second end portions of each of the respective single eyelet laces projecting on opposite sides of the spine and with the respective central portions of the single eyelet laces being spaced from one another a distance sufficient to permit the aglets of respective single eyelet laces to be threaded into respective eyelets of the shoe or garment.

2. The lace product according to claim 1, wherein the spine is made of a fabric.

3. The lace product according to claim 1, wherein the spine is made of ballistic nylon.

4. The lace product according to claim 3, wherein the means for securing comprises an aramid thread.

5. The lace product according to claim 4, wherein the tensile strength of the aramid thread is at least 50 lbs.

6. The lace product according to claim 4, wherein the aramid thread is the same color as the ballistic nylon.

7. The lace product according to claim 6, wherein the spine is flat.

8. A lace product for threading into a shoe or garment comprising:

(a) a plurality of single eyelet laces, each of the single eyelet laces comprising first and second end portions and a central portion, each of the first and second end portions of the single eyelet laces comprising an aglet affixed thereto;

(b) a spine;

(c) means for securing each of the plurality of single eyelet laces to the spine with a tensile force having a magnitude of at least 400 lbs;

wherein the means secures the central portion of each of the respective plurality of single eyelet laces to the spine with the first and second end portions of each of the respective single eyelet laces projecting on opposite sides of the spine and with the respective central portions of the single eyelet laces being spaced from one another a distance sufficient to permit the aglets of respective single eyelet laces to be threaded into respective eyelets of the shoe or garment.

9. A lace product for threading into a shoe or garment comprising:

(a) a plurality of single eyelet laces, each of the single eyelet laces comprising first and second end portions and a central portion, each of the first and second end portions of the single eyelet laces comprising an aglet affixed thereto;

(b) a spine;

(c) means for securing each of the plurality of single eyelet laces to the spine such that the single eyelet laces cannot be manually separated from the spine by application of a tensile force;

wherein the means secures the central portion of each of the respective plurality of single eyelet laces to the spine with the first and second end portions of each of the respective single eyelet laces projecting on opposite sides of the spine and with the respective central portions of the single eyelet laces being spaced from one another a distance sufficient to permit the aglets of respective single eyelet laces to be threaded into respective eyelets of the shoe or garment.

10. The lace product according to claim 9, wherein the means for securing comprises an aramid thread.

11. The lace product according to claim 10, wherein the tensile strength of the aramid thread is at least 50 lbs.

12. The lace product according to claim 11, wherein the spine is made of ballistic nylon.

13. The lace product according to claim 12, wherein the aramid thread is the same color as the ballistic nylon.

* * * * *